US006981433B2

(12) United States Patent
Hsien

(10) Patent No.: US 6,981,433 B2
(45) Date of Patent: Jan. 3, 2006

(54) RATCHET WHEEL MOUNTING STRUCTURE FOR WRENCH

(76) Inventor: Chih-Ching Hsien, 235 Chung-Ho Box 8-24, Taipei (TW)

( * ) Notice: Subject to any disclaimer, the term of this patent is extended or adjusted under 35 U.S.C. 154(b) by 23 days.

(21) Appl. No.: 10/736,104

(22) Filed: Dec. 16, 2003

(65) Prior Publication Data

US 2004/0123701 A1 Jul. 1, 2004

Related U.S. Application Data

(63) Continuation-in-part of application No. 10/213,301, filed on Aug. 7, 2002, now abandoned.

(51) Int. Cl.
*B25B 13/46* (2006.01)

(52) U.S. Cl. ..... 81/60

(58) Field of Classification Search ..... 81/60–63.2
See application file for complete search history.

(56) References Cited

U.S. PATENT DOCUMENTS 6,408,722 B1 * 6/2002 Chen ..... 81/60
6,467,378 B1 * 10/2002 Chen ..... 81/60

* cited by examiner

*Primary Examiner*—Debra S Meislin

(57) ABSTRACT

A ratchet wheel mounting structure comprises a ratchet wheel mounted in a box of a wrench body and meshed with a toothed stop block in said box, and a retainer ring mounted in between said box and said ratchet wheel to secure said ratchet wheel to said box, said ratchet wheel having teeth arranged around the periphery thereof, a locating block at one side of the ratchet wheel, and a locating groove being formed around the periphery of said locating block for positioning said retainer ring. Each tooth of said ratchet wheel is chamfered at one end thereof far away from the locating block; and a reinforcing bevel is provided in the valley between roots of another ends of each two adjacent teeth of said ratchet wheel adjacent to said locating block. Or each tooth is chamfered at two ends and thus no bevel slop is formed.

2 Claims, 8 Drawing Sheets

RATCHET WHEEL MOUNTING STRUCTURE FOR WRENCH

The present invention is a continuation in part (CIP) of U.S. patent Ser. No. 10/213,301, now abandoned, filed Aug. 7, 2002, assigned to the inventor of the present invention, thereby, the content of U.S. patent Ser. No. 10/213,301 is incorporated into the present invention as a part of the present invention.

FIELD OF THE INVENTION

The present invention relates to wrenches, and more specifically, to a ratchet wheel mounting structure for wrench, which achieves high performance.

BACKGROUND OF THE INVENTION

FIGS. 1 and 2 show two different ratchet wheel designs according to the prior art. These ratchet wheels are made through latching and milling processes, having R-angle or straight teeth. The teeth of these ratchet wheels wear quickly as used for a longer time and have low torque values. Further, when the prior art wrench is engaged with the toothed stop block in the box of the wrench, but, in this prior art, output force is not fully transferred from the wrench to the ratchet wheel and then to a workpiece. FIG. 3 shows still another design of ratchet wheel according to the prior art. According to this design, the ratchet wheel has a disk-like reinforcing structure integrally formed with the teeth at one end to reinforce the structural strength of the teeth. In either of the aforesaid three prior art ratchet wheel designs, the two distal ends of each teeth of the ratchet wheel art has right angles with respect to the base locating the teeth. When the wrench is twisted to rotate a workpiece, the teeth of the ratchet wheel may break easily, and the friction between the ends of each teeth of the ratchet wheel and the inside wall of the box of the wrench affects the performance of the wrench. Another drawback of the aforesaid prior art ratchet wheel designs is the difficulty in installing the C-shaped retainer ring. Because if the width of the two distal ends of the C-shaped retainer ring that secures the ratchet wheel in the box of the wrench is equal to the width of the locating groove of the ratchet wheel, it is not easy to fasten the C-shaped retainer ring to the locating groove of the ratchet wheel. Furthermore, because the pressure angle of the aforesaid prior ratchet wheel designs is 14.5° or 20 degrees, the engagement between the teeth and the stop block is not in coincidence with the pressure line, resulting in weak structural strength.

SUMMARY OF THE INVENTION

The present invention has been accomplished to provide a ratchet wheel mounting structure, which eliminates the aforesaid drawbacks.

It is one object of the present invention to provide a ratchet wheel mounting structure which comprises a ratchet wheel mounted in a box of a wrench body and meshed with a toothed stop block in said box, and a retainer ring mounted in between said box and said ratchet wheel to secure said ratchet wheel to said box, said ratchet wheel having teeth arranged around the periphery thereof, a locating block at one side of the ratchet wheel, and a locating groove being formed around the periphery of said locating block for positioning said retainer ring. Each tooth of said ratchet wheel is chamfered at one end thereof far away from the locating block; and a reinforcing bevel is provided in the valley between roots of another ends of each two adjacent teeth of said ratchet wheel adjacent to said locating block. Or each tooth is chamfered at two ends and thus no bevel slop is formed.

DETAILED DESCRIPTION OF THE PREFERRED EMBODIMENT

Figure 3:
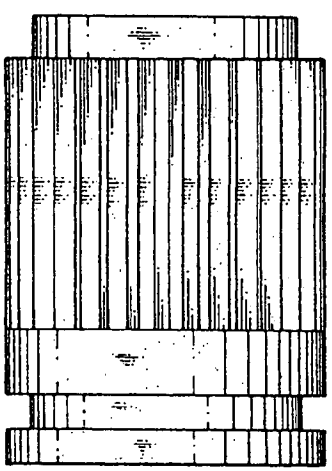
Fig. 3(PRIOR ART)
FIG. 3 illustrates still another structure of the ratchet wheel of the prior art.
Figure 2:
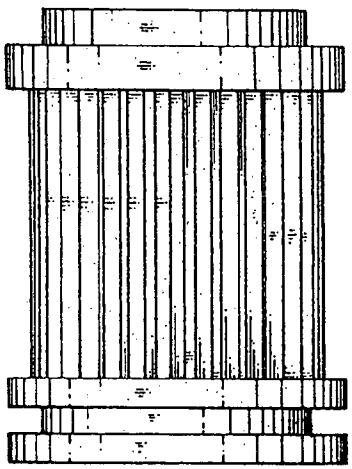
Fig. 2 (PRIOR ART)
FIG. 2 illustrates another structure of the ratchet wheel of the prior art.
Figure 1:
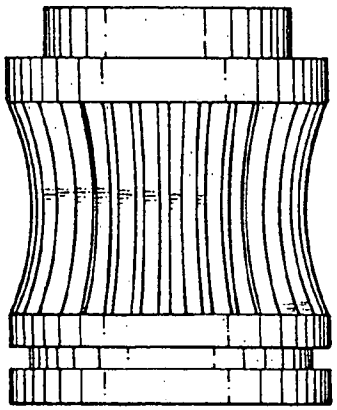
Fig. 1 (PRIOR ART)
FIG. 1 illustrates a ratchet wheel of the prior art.
Figure 4:
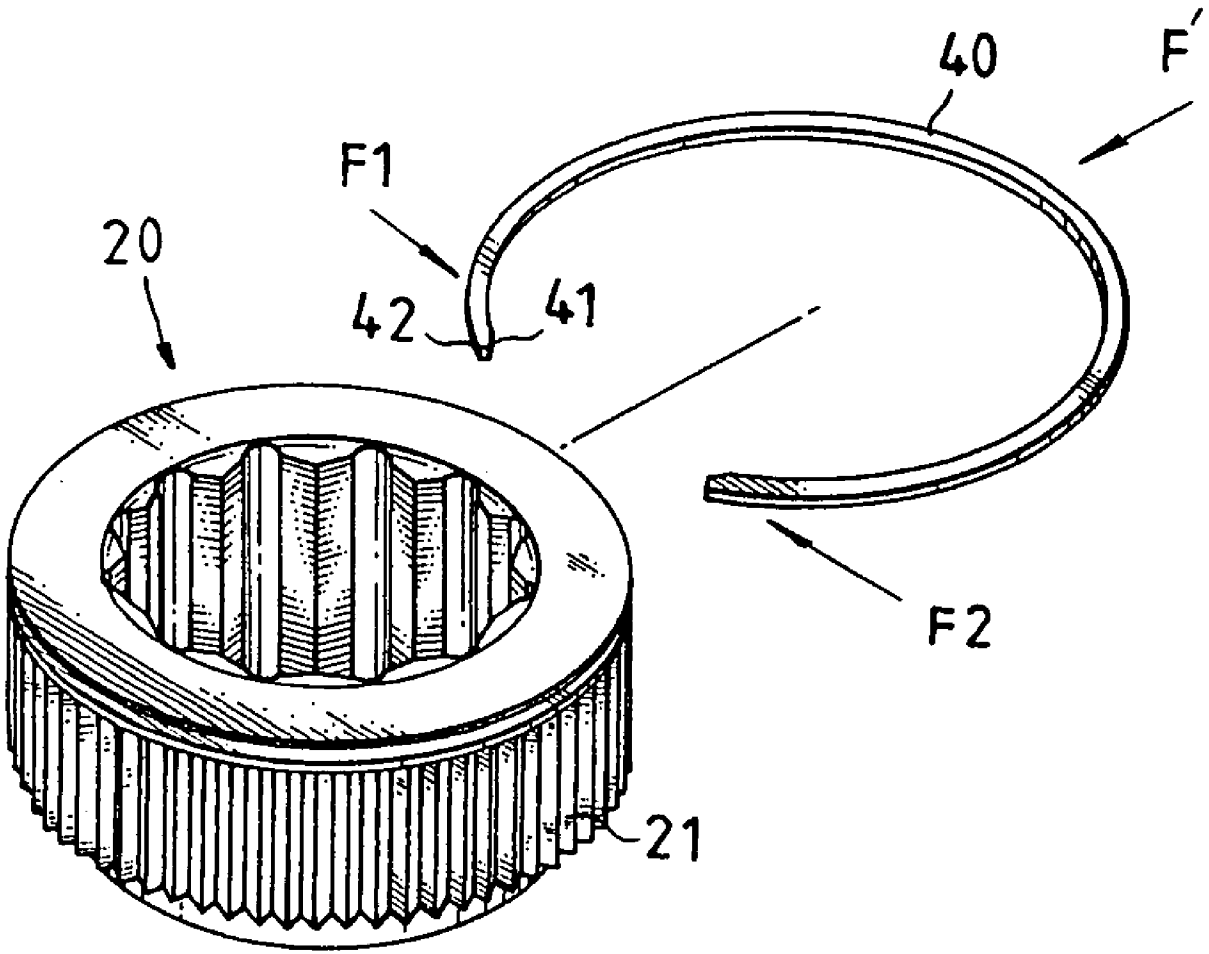
FIG. 4 is an exploded view showing the structure of a ratchet wheel and a C-shaped retainer ring according to the present invention.
Figure 5:
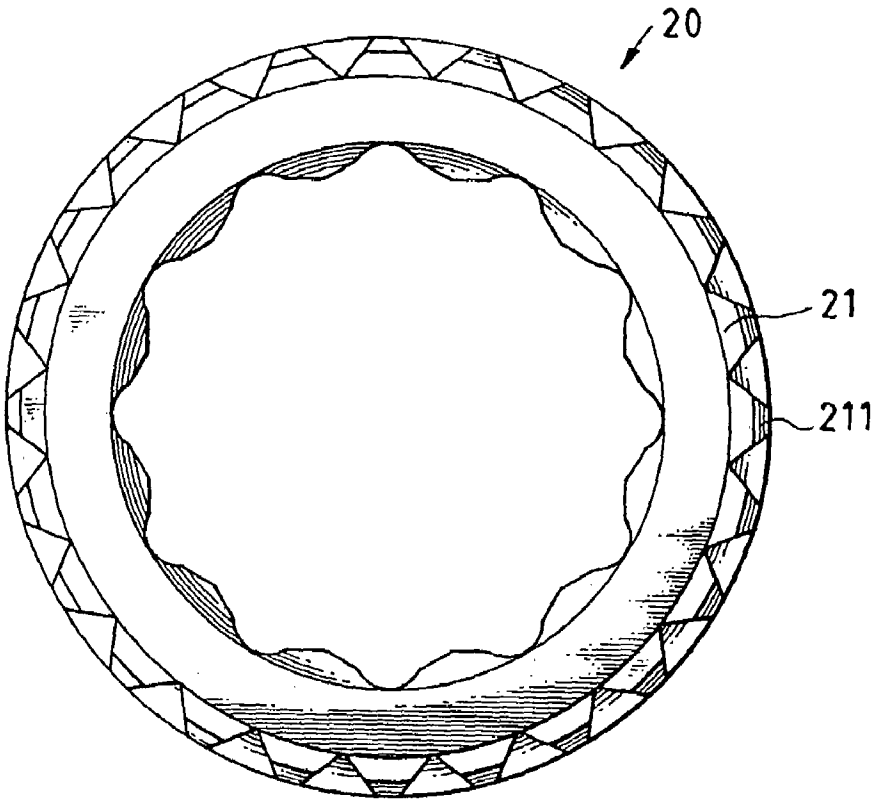
FIG. 5 is a plain view of the ratchet wheel according to the present invention.
Figure 13:
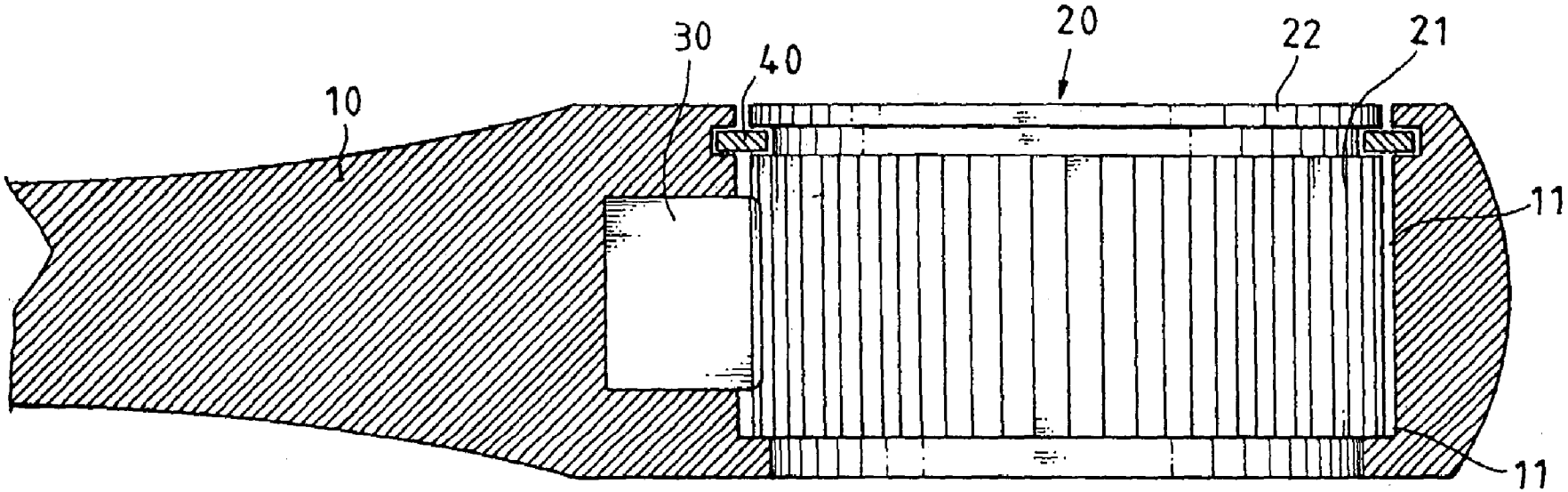
FIG. 13 is a sectional view showing the ratchet wheel installed in the box of the wrench and meshed with the toothed block in the box according to the present invention.

Referring to FIGS. 4, 5 and 13, a ratchet wheel 20 and a stop block 30 are mounted in the box 11 of a wrench body 10. The stop block 30 is a toothed member engaged with the ratchet wheel 20 and adapted to control the direction of rotation of the ratchet wheel 20.

The ratchet wheel 20 has teeth 21 arranged around the periphery thereof, a locating block 22 at one side thereof, and a locating groove 221 extended around the locating block 22 for the positioning of a retainer ring 40, which secures the ratchet wheel 20 to the inside of the box 11 of the wrench body 10. The outer diameter of the locating block 22 is equal to the outer diameter around the teeth 21.

Figure 6:
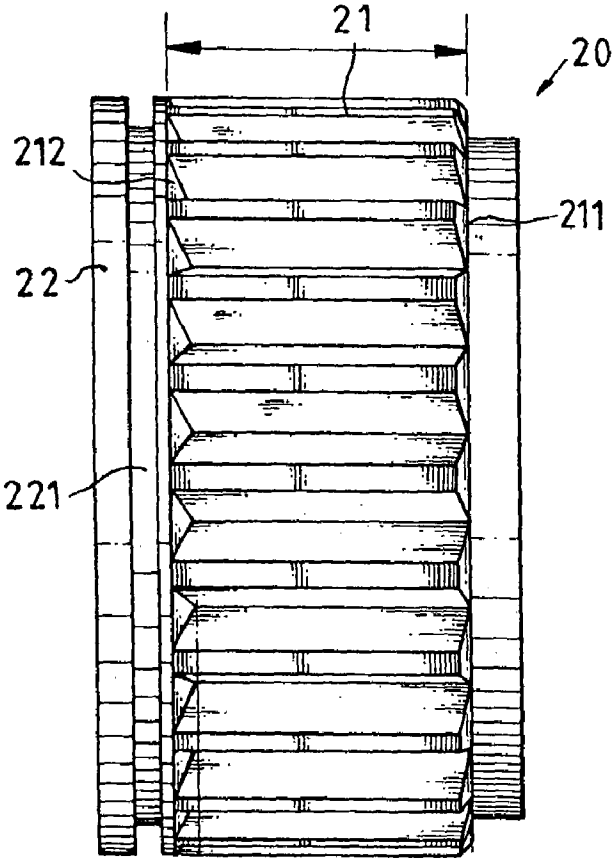
FIG. 6 is a schematic view illustrating the chamfer angle of the teeth of the ratchet wheel.
Figure 12:
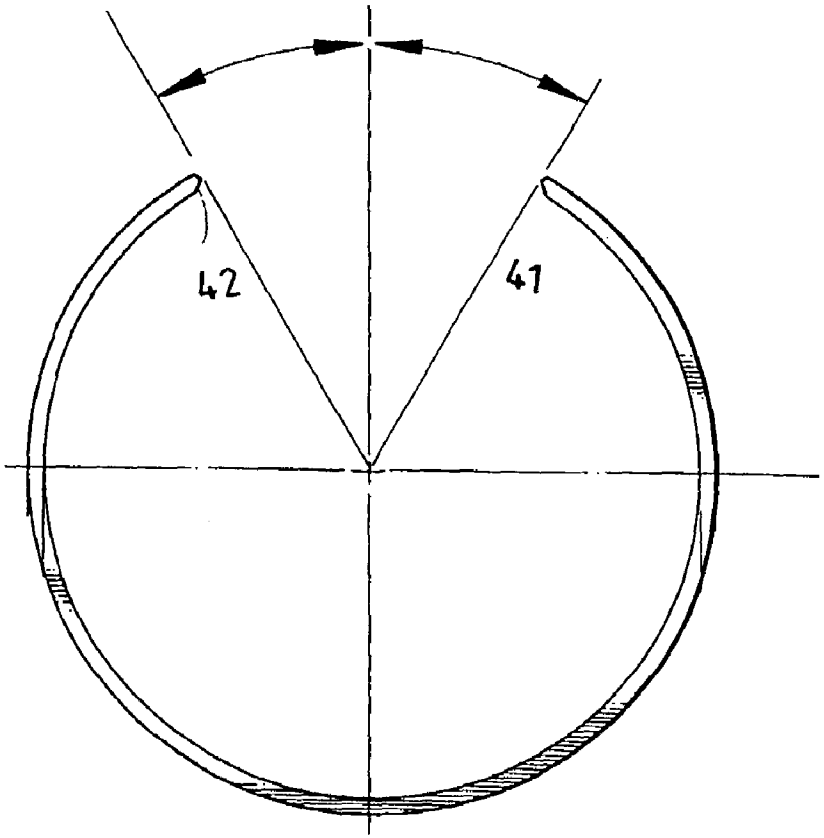
FIG. 12 is a schematic drawing explaining the design of the C-shaped retainer ring according to the present invention.

Referring to FIG. 6, each tooth 21 has a chamfered end 211 at one end thereof. Further, a reinforcing bevel end 212 is provided in the valley between another ends of each two adjacent teeth 21 adjacent to the locating block 22. The structure will reinforce the structural strength of the teeth for smooth rotation. The retainer ring 40 is a C-shaped ring. Referring to FIG. 12, the ring 40 has two ends and each end has a respective cut angle 41, 42 at an inner side thereof for quick installation. By means of the aforesaid features, the ratchet wheel 20 is strong and wear resistant, and can easily be installed in the wrench for smooth operation.

Figure 7:
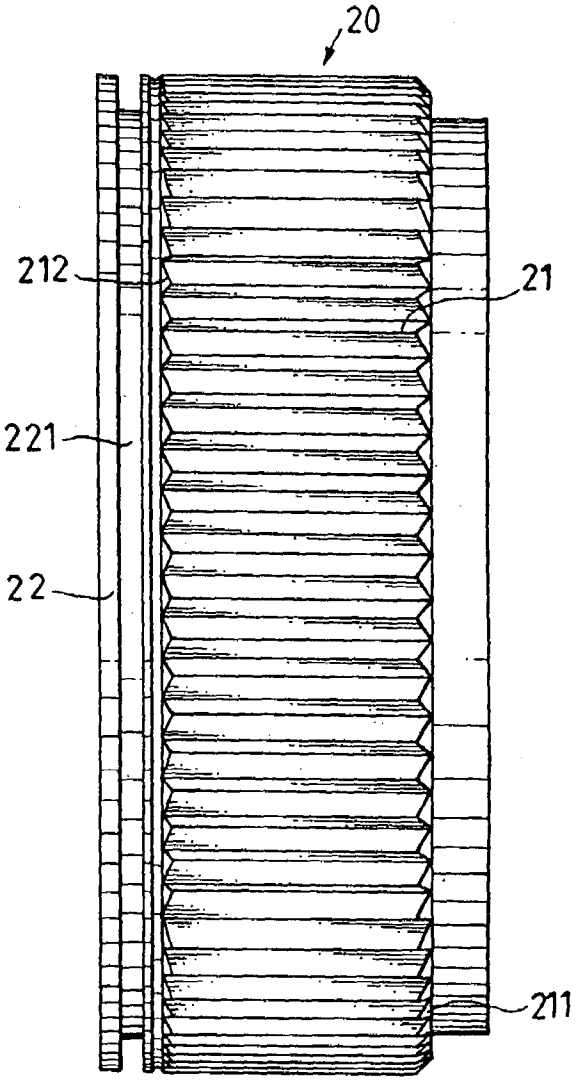
FIG. 7 is a side view of the ratchet wheel according to the present invention.
Figure 8:
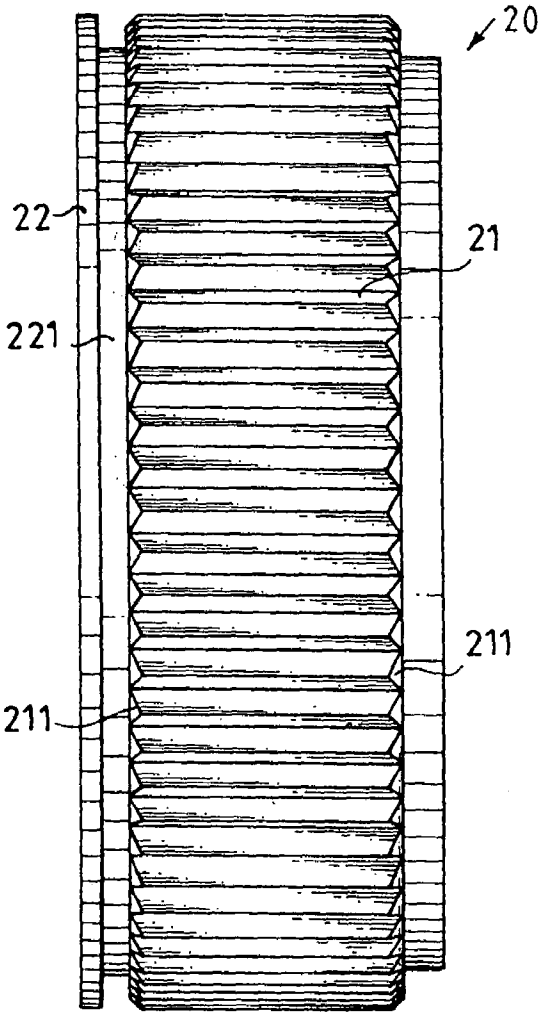
FIG. 8 is a side view of an alternate form of the ratchet wheel according to the present invention.

Referring to FIGS. 7 and 8, another embodiment of the present invention is illustrated. In this embodiment, each tooth 21 has chamfer ends 211 at two ends thereof. The structure will reinforce the structural strength of the teeth for smooth rotation. Similarly, the retainer ring 40 is a C-shaped ring. The Ring 40 has two ends and each end has a respective cut angle 41, 42 disposed at two inner sides thereof for quick installation. By means of the aforesaid features, the ratchet wheel 20 is strong and wear resistant, and can easily be installed in the wrench for smooth operation.

Figure 9:
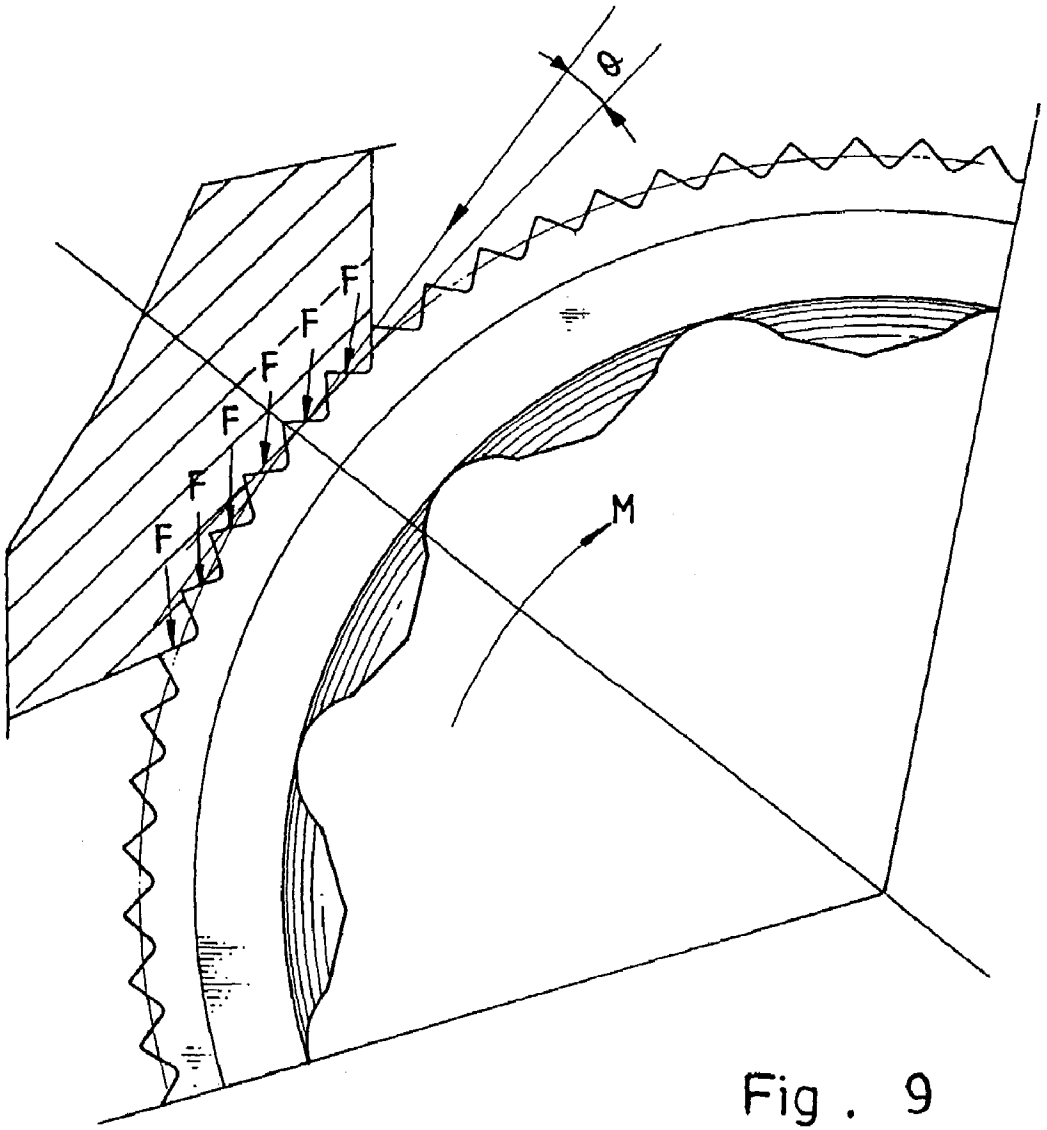
FIG. 9 is a schematic view illustrated the best pressure angle.

As shown in FIG. 9, a pressure angle θ is illustrated. The pressure angle is an angle between two tangent lines tangent from two points on the periphery of the ratchet wheel, where the two points are distant with one teeth.

In FIG. 9, the engagement between the stop block 30 and the ratchet wheel 20 is illustrated that the pressure angle θ of the ratchet wheel 20 is set within 10~13°. In this case, the applied force F of the wrench drives the teeth 21 of the ratchet wheel 20 perpendicularly. According to the principle of transmission of force, the output force is 100% when pushing the load with a force F at right angle, but if a force F is applied to the work piece at a tilted angle, and ineffective component of force will be produced during the output of force F, and the output of force will be below 100%. The greater the contained angle of the tilted output force is, the greater the ineffective component of force will be. By means of the aforesaid tooth arrangement, the effective component of force to the ratchet wheel is greatly increased to improve the working efficiency of the wrench.

Figure 11:
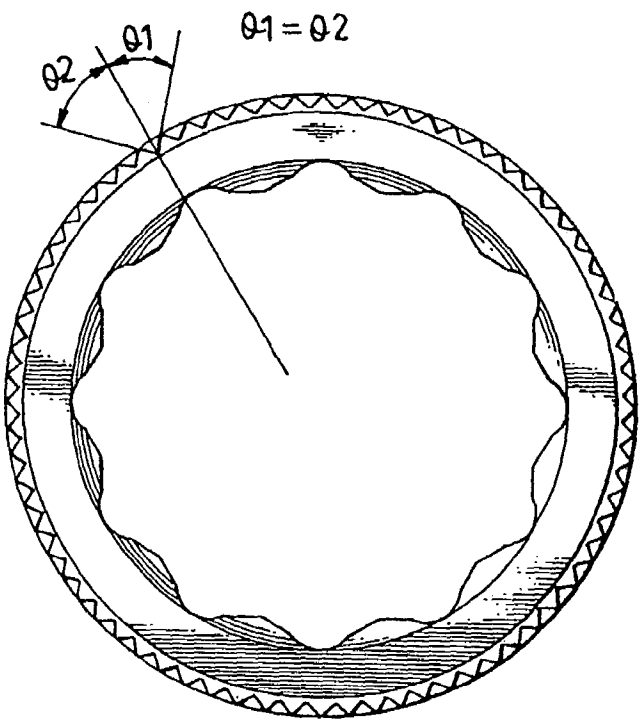
FIG. 11 is a plain view of a ratchet wheel with teeth of unequal angle tooth form according to the present invention.
Figure 10:
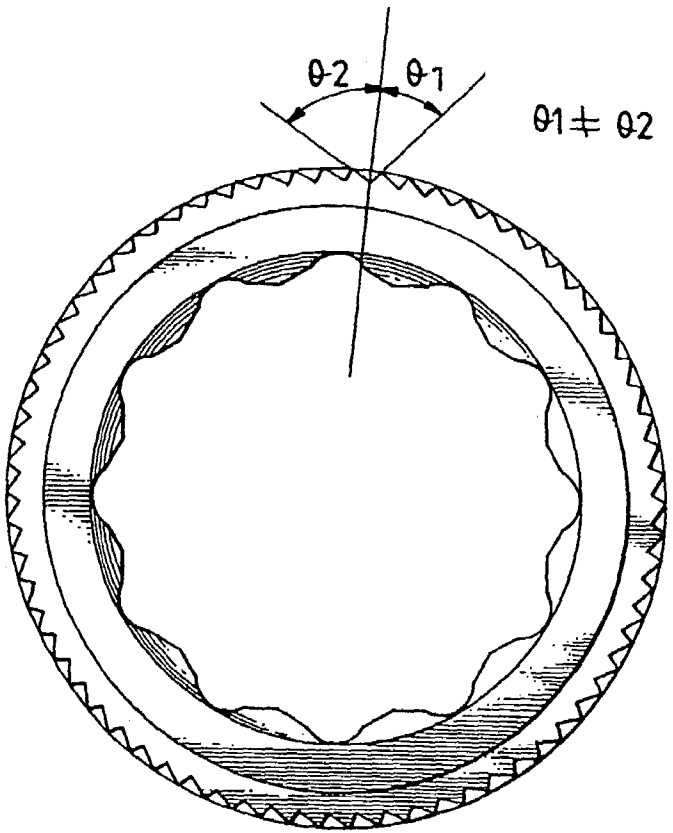
FIG. 10 is a plain view of a ratchet wheel with teeth of equal angle tooth form according to the present invention.

Referring to FIGS. 10 and 11, the teeth of the ratchet wheel can be either of unsymmetrical type of equal angle design, as shown in FIG. 10, wherein the two angles θ1 and θ2 are unequal (where θ1 and θ2 are angles of one of two adjacent sides and a radial line passing through the apex of the connection of the two sides), or symmetrical type of unequal angle design, as shown in FIG. 11, wherein the two angles θ1 and θ2 are unequal.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A ratchet wheel mounting structure comprising a ratchet wheel mounted in a box of a wrench body and meshed with a toothed stop block in said box, and a retainer ring mounted in between said box and said ratchet wheel to secure said ratchet wheel to said box, said ratchet wheel having teeth arranged around the periphery thereof, a locating block at one side of the ratchet wheel, and a locating groove being formed around the periphery of said locating block for positioning said retainer ring, and wherein each tooth of said ratchet wheel is chamfered at one end thereof far away from the locating block; and a reinforcing bevel is provided in the valley between roots of another ends of each two adjacent teeth of said ratchet wheel adjacent to said locating block.

2. The ratchet wheel mounting structure as claimed in claim 1 wherein said retainer ring has a C shape ring having two ends; and an inner side of each end is chamfered.

* * * * *